United States Patent [19]

Blair

[11] Patent Number: 4,776,286

[45] Date of Patent: Oct. 11, 1988

[54] PORTABLE AIR CURTAIN BLOWER

[76] Inventor: Leonard G. Blair, 400 Penn's Rd., Malvern, Pa. 19355

[21] Appl. No.: 127,388

[22] Filed: Dec. 2, 1987

[51] Int. Cl.[4] ..... B09B 3/00

[52] U.S. Cl. ..... 110/235; 98/36; 110/203; 110/297

[58] Field of Search ..... 110/203, 235, 297; 98/36

[56] References Cited

U.S. PATENT DOCUMENTS

| | | | |
|---|---|---|---|
| 3,704,676 | 12/1972 | Davies et al. | 110/203 X |
| 3,773,000 | 11/1973 | Applegate | 110/203 |
| 3,899,984 | 8/1975 | Keyes et al. | 110/203 |
| 3,927,626 | 12/1975 | Fokakis et al. | 110/220 |
| 4,161,916 | 7/1979 | Applegate | 110/203 |

*Primary Examiner*—Edward G. Favors
*Attorney, Agent, or Firm*—Joseph Scafetta, Jr.

[57] ABSTRACT

An air blower is used with an open fire incineration pit dug below ground level. The blower includes a motor and a fan driven by the motor. A plenum chamber receives air from the fan and has a cross-sectional shape of at least three sides including a flat base flush with the ground level and a front side sloping away from the pit. Preferably, the plenum chamber has a trapezoidal cross-section. A nozzle connected to the plenum chamber jets an air curtain over the open fire in the pit. A protective fence attachable to the plenum chamber surrounds the pit. Also, there may be one or more telescoping sections slidable out of either one or both opposite ends of the plenum chamber for jetting additional air curtains over the open fire in the pit.

14 Claims, 5 Drawing Sheets

PORTABLE AIR CURTAIN BLOWER

BACKGROUND OF THE INVENTION

1. Field of the Invention

The invention relates to furnaces generally and, in particular, to a portable air curtain blower for an open incineration pit.

2. Description of the Related Art

It has been a problem to eliminate or dispose of solid waste where open field or pit burning is prohibited. However, if open burning is permitted, it is also a problem to burn the waste, cheaply, cleanly, and legally on a site in a controlled manner in conformity with state and local rules and regulations.

Controlled burning at high temperatures has been found to be the best method to incinerate waste in most commercial, industrial and municipal applications. Such controlled burning is suitable for incinerating land clearing debris, including tree stumps from construction or road work, combustible demolition site waste, and seasonal collections of leaves, limbs and brush. High temperature burning also minimizes the danger of fire spreading due to wind and drought because of the controls which are in place.

However, the known devices in the prior art have not been satisfactory either from a safety standpoint or from the standpoint of meeting the strictest rules and regulations currently in effect.

For example, U.S. Pat. Nos. 3,773,000 and 4,161,916 to Applegate both disclose an apparatus for the controlled incineration of waste in an open pit. However, because of the heat generated against the earthen wall underneath the apparatus, there is a tendency for the earthen wall to collapse under the weight of the apparatus, thus causing the apparatus to roll into the pit.

Another prior art device for incinerating waste is disclosed in U.S. Pat. No. 3,927,626 to Fokakis et al. Although it is suitable for burning material in "a well defined hole in the earth", the apparatus is unfortunately not portable and it is too bulky to be converted to a portable device. In fact, in the preferred embodiment, the incineration pit is fixed and has a wall structure "of metal, fire brick, or other heat resistant material."

The prior art device disclosed in U.S. Pat. No. 3,899,984 to Keyes et al is portable and is suitable for open pit burning of waste. Also, because of the orientation of the wheels of the device, this apparatus does not have the tendency to roll into the pit. Nevertheless, since the device is made up out of a plurality of large segments connected end to end, it is difficult and time-consuming to put the apparatus together and to move it from site to site. Furthermore, if the segments are not tightly secured together by the unskilled field workers, the device operates inefficiently due to the leakage of air through the cracks left between adjoining segments.

Thus, it remains a problem in the prior art to develop an efficient and portable air blower for use adjacent to an open earthen incineration pit that meets strict environmental standards without the tendency of the blower to fall into the pit.

SUMMARY OF THE INVENTION

An air curtain blower is portable and efficient for use adjacent to an open earthen fire pit in which waste and debris are incinerated. The blower and pit arrangement meets the strictest environmental rules and regulations for open pit burning. Furthermore, the blower is safely operated without the danger of its falling into the pit because of the unique orientation of the wheels of the device.

The blower essentially puts a lid on air pollutants by covering the fire in the pit with an invisible, high-velocity, sealing air curtain that is penetrated only when more material is loaded into the pit for burning.

The blower may be easily set up next to the pit by only one worker in a matter of minutes. This fast set-up next to the pit allows the blower to follow, for example, a land clearing operation around a field through the use of multiple burning pits dug throughout the job site. Thus, productivity is increased and costly heavy equipment time is saved in moving to and from a single pit.

The blower has a wide base which seals the ground at the edge of the pit so that no air is blown behind the blower and also so that the stability of the blower is increased.

The air curtain produced by the blower increases the burning rate up to an estimated six times over the burning rate of conventional open pits where no air curtain is blown over the fire. The yield of material burned by the present invention is approximately three to seven tons per hour based on the size of the pit. Also, complete burning of the material is insured by the air curtain which creates extremely high combustion temperatures and turbulence in the pit.

Finally, combustibles are reduced to only about 1% or less of their original volume through burning controlled by the air curtain blower. Thus, landfill life is increased and groundwater pollution is inhibited by the compact ash left over after burning.

These and other advantages of the present invention will become more readily understood from an examination of the following brief description of the drawings and the subsequent detailed description of the preferred embodiments.

DETAILED DESCRIPTION OF THE PREFERRED EMBODIMENTS

Figure 1:
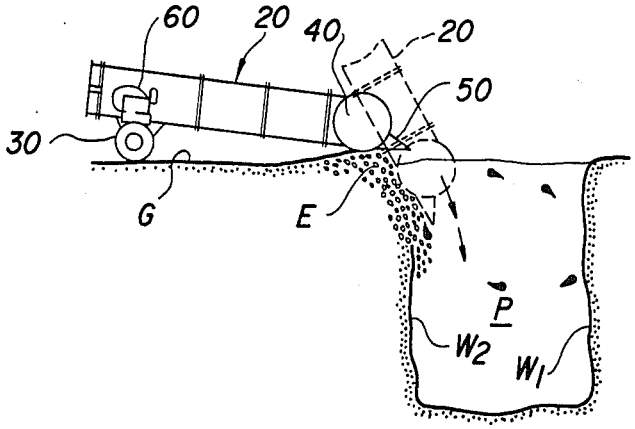
FIG. 1 PRIOR ART
FIG. 1 is a side elevational view of a prior art device in operation.

In FIG. 1, a prior art device 20 is shown with wheels 30 resting on the ground G and with a tubular plenum chamber 40 resting on an edge E of an open incineration pit P. This pit P has been dug below the level of the ground G so that the pit P has earthen walls W. The chamber 40 has a nozzle 50 through which a curtain of air is blown by a fan (not shown) controlled by a motor 60. The air blown through the nozzle 50 strikes the opposite earthen wall $W_1$, and is recirculated to the earthen wall $W_2$ underneath the chamber 40. As the earth in the wall $W_2$ dries out because of the air and combustion products striking against it, the wall $W_2$ becomes weak and collapses under the weight of the chamber 40. Because the wheels 30 are oriented parallel to the direction of the air curtain, the device 20 (as shown in phantom lines) tends to roll into the pit P whenever the edge E under the chamber 40 crumbles.

Figure 2:
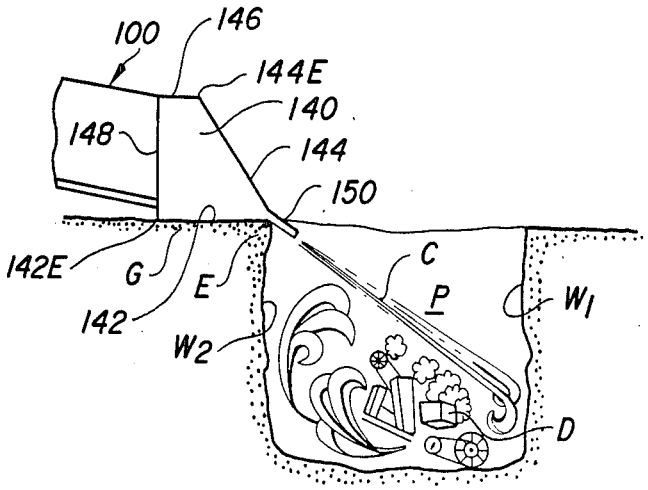
FIG. 2 is a partial side elevational view of the present invention in operation.

In FIG. 2, a partial view of a first embodiment of the blower 100 of the present invention is shown. The blower 100 has a plenum chamber 140 with a nozzle 150 through which a curtain C of air is jetted into the pit P over a fire containing debris D to be incinerated. Although the walls $W_1$ and $W_2$ dry out because of the air and combustion products striking them, there is no tendency either for the wall $W_2$to collapse or for the edge E to give way because the ground G under the chamber 140 is sealed from the heat of the combustion products and is kept moist under a wide flat base 142 of the plenum chamber 140. Because of its width and flatness, the base 142 is flush with the ground G and stabilizes the blower 100 so that the blower 100 does not have the tendency to slip into the pit P, even if the wall $W_2$ is weakened.

Although the chamber 140 may have a cross-sectional shape with at least three sides, the preferred shape is a trapezoid with a flat base 142 and a front side 144 sloping away from the pit P. Even though the preferred shape is a trapezoid, the orientation of a top side 146 and a rear side 148 of the chamber 140 are not critical and neither one of them needs to be parallel to either the base 142 or the front side 144. A trapezoid is defined in Webster's New collegiate Dictionary (1981) at page 1234 as a "quadrilateral having only two sides parallel." Thus, the shape may be a trapezium which is defined by Webster as "a quadrilateral having no two sides parallel". Furthermore, there may be only a single third side joining the far edge 142E of the base 142 in a straight line with the top edge 144E of the front side 144, thus making the cross-sectional shape of the chamber 140 triangular. In any case, the nozzle 150 is connected to the chamber 140 at the junction of the flat base 142 and the sloping front side 144.

The wide flat base 142 effectively prevents the air and the turbulent combustion gases generated by the curtain C from going underneath the trapezoidal chamber 140, unlike the round chamber 40 which is ineffective in FIG. 1 in sealing the prior art device 20 against fluid flow thereunder.

Figure 3:
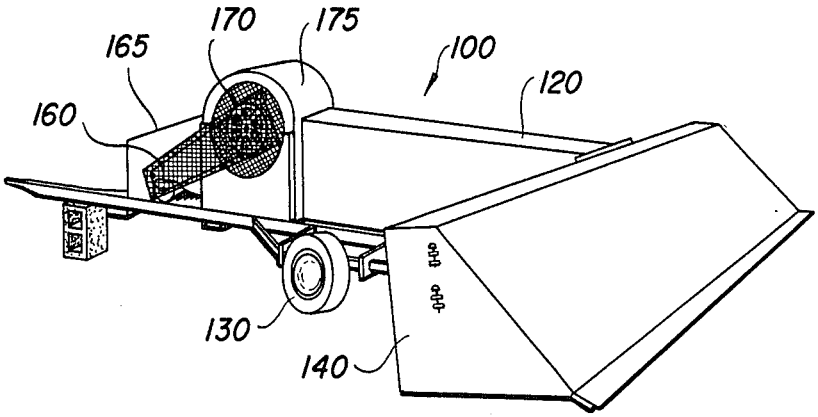
FIG. 3 is a perspective view of the front and one side of the present invention set up for operation.

In FIG. 3, the blower 100, which is the first embodiment of the present invention, is shown set up and ready for operation. The plenum chamber 140 is hollow and connected to a duct 120 which serves as a conduit for air generated by a fan 170 run by a motor 160. The fan 170 operates at a very low rpm (revolutions per minute) level for increased bearing life and also is enclosed in a housing 175 for reducing noise levels. The fan 170 is a turbine bucket-type which is more efficient than a prop type in its ability to generate high air pressure, to meet heavy horsepower requirements, and to obtain excellent fuel economy. The motor 160 is protected from the fire in the pit P and the heat generated therefrom by being placed behind the fan housing 175, instead of by the side of the fan 170, as is the case of the motor 60 in the prior art device 20 shown in FIG. 1. Also, as shown in FIG. 3, the motor 160 is protected from the weather and vandals by being enclosed in a lockable housing 165 made of a heavy metal such as steel. Preferably, the motor 160 is a three-cylinder, air-cooled diesel engine capable of operating at a maximum of 33 horsepower. Fuel consumption is less than 1.3 gallons per hour and the fuel capacity of an attached gasoline tank (not shown) is in excess of ten hours of continuous running time.

Figure 4:
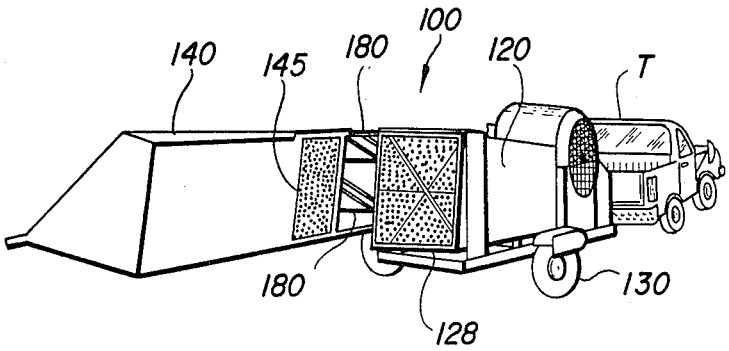
FIG. 4 is a perspective view of the rear and one side of the present invention folded and hitched to the back of a pickup truck for transportation to a job site.

In FIG. 4, the blower 100 is shown folded and hitched to the back of a pick-up truck T. Wheels 130 allow the blower 100 to be transported from one job site to another. The plenum chamber 140 is separated from the duct 120 by hinge bars 180 which swing out to allow the chamber 140 to be aligned parallel to the duct 120 for hauling without the necessity of meeting special highway regulations for transporting wide loads. When the hinge bars 180 are used to bring the chamber 140 back into an operational condition with the duct 120, an exit passage 128 for air leaving the duct 120 is aligned and locked into place with an inlet passage 145 for air entering the chamber 140.

Figure 5:
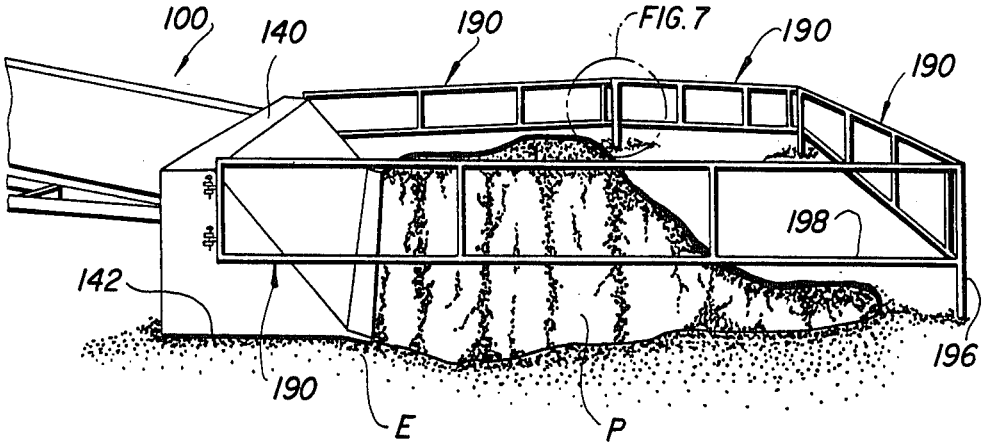
FIG. 5 is a partial perspective view of the present invention set up along an edge of an open incineration pit with a protective fence therearound.
Figure 7:
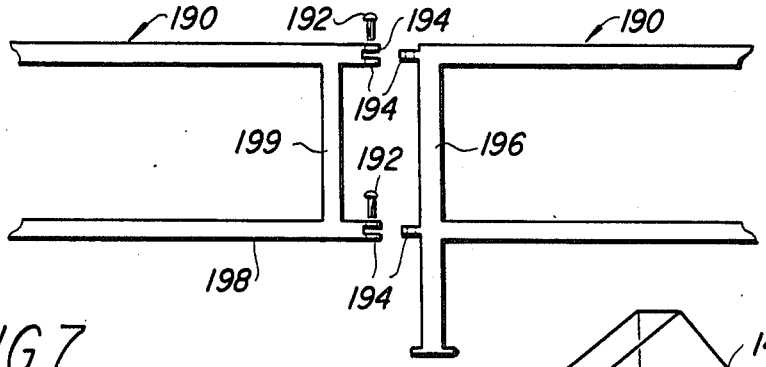
FIG. 7 is an exploded side elevational view enlarged from FIG. 5 showing two adjacent sections of the protective fence used in the present invention.

In FIG. 5, the blower 100 is set up with its plenum chamber 140 along an edge E of an open pit P. A plurality of protective fence sections 190, specifically four in number, surround the pit P and are attached at opposite ends of the chamber 140. The specific manner in which the fence sections 190 are attached to the chamber 140 and to each other is best shown in FIG. 7 to be described hereinafter. Basically, in FIG. 5, each fence section 190 has a single leg 196 and at least one rectangular frame 198 extending from a side of the leg 196. Three such rectangular frames 198 are shown extending end-to-end from the single leg 196 of each fence section 190 in FIG. 5.

Referring now to FIG. 7, which is an exploded view of part of FIG. 5, two fence sections 190 are shown ready to be connected together. A single pin 192 slips through holes in small plates 194 of which one plate 194 extends from the single leg 196 of the right fence section 190 and two plates 194 extend together from an upright end 199 of the rectangular frame 198 of the left fence section 190.

Returning to FIG. 6, it may be seen that the four protective fence sections 190 have been removed from the area around the pit P and are now stored on one of a plurality of side walls 125 of the duct 120 leading from the housing 175 for the fan 170 to the plenum chamber 140.

Figure 6:
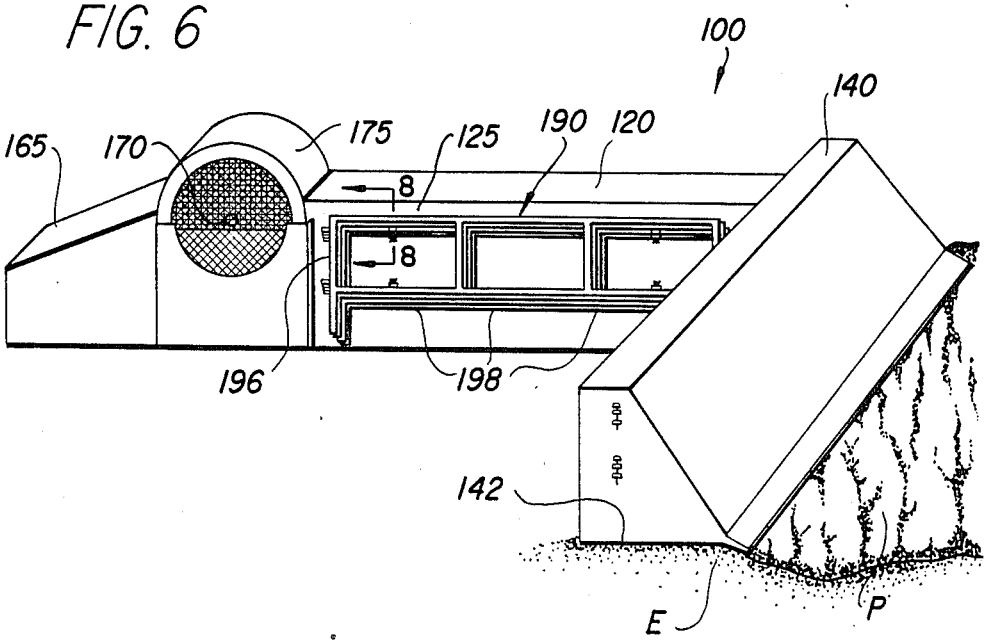
FIG. 6 is a perspective view of the front and one side of the present invention along the edge of the open pit with the protective fence in its stored position on the invention.
Figure 8:
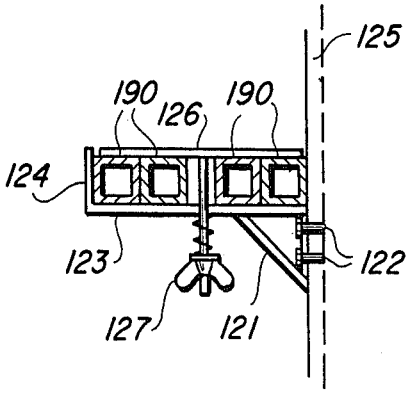
FIG. 8 is a cross-sectional view taken along line 8—8 in FIG. 6 of a device for securing the protective fence in its stored position on the present invention.

The exact device on which the fence sections 190 with their single legs 196 and their rectangular frames 198 are mounted for storage is shown in detail in FIG. 8 which is a view taken along line 8—8 of FIG. 6.

In FIG. 8, the side wall 125 has a bracket 121 extending therefrom. This bracket 121 is secured to the side wall 125 by rivets 122. A horizontal plate 123 is welded to the top of the bracket 121 and has an upturned outer end 124 that functions to keep the four fence sections 190 from slipping off the horizontal plate 123. A spring-loaded T-bar 126 prevents the four fence sections 190 from jumping over the upturned end 124 by clamping such sections 190 down on the horizontal plate 123 with a wing nut 127. In FIG. 8, the wing nut 127 is shown in its loosened condition.

Returning briefly to FIG. 6, it may be seen that there are four mounting arrangements for securing the fence sections 190 to the side wall 125 of the duct 120.

The protective fence shown in FIGS. 5-8 and described hereinabove is intended as a safety device for preventing people, animals, and equipment for accidentally falling into the open pit P.

Figure 9:
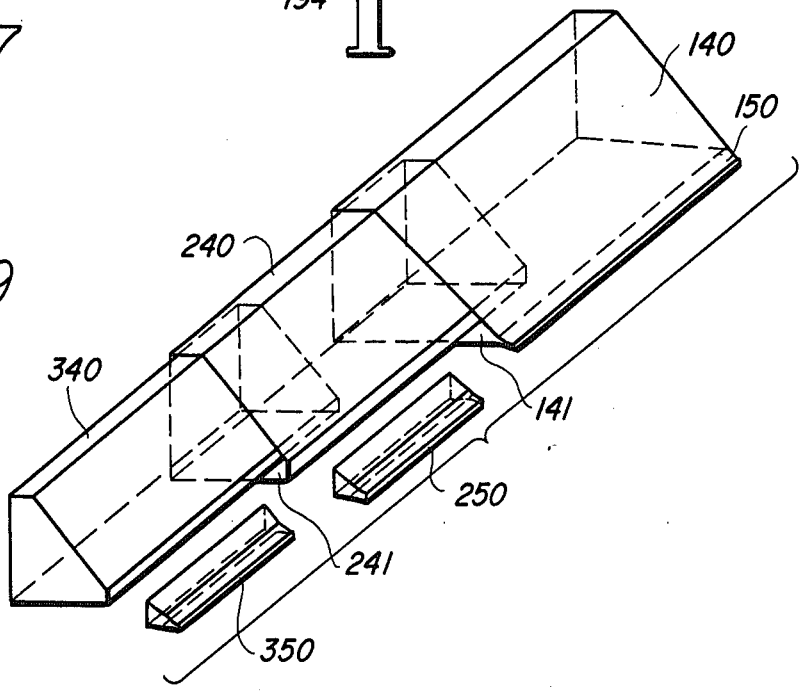
FIG. 9 is a perspective view of a second embodiment of the present invention with two sections telescoping out of the same side of the plenum chamber and with a nozzle being attached to the front of each section.

Proceeding to FIG. 9, a second embodiment of the present invention is shown in which a first telescoping section 240 slides out of one end 141 of the plenum chamber 140 while a second telescoping section 340 slides out of one end 241 of the first telescoping section 240 in the same direction. Although the length of the chamber 140 is fixed, the lengths of the first telescoping section 240 and the second telescoping section 340 may vary depending upon the needs of the operator. Also, although the nozzle 150 is formed integrally with the plenum chamber 140, a first nozzle-like snout 250 on the first telescoping section 240 and a second nozzle-like snout 350 on the second telescoping section 340 may be clipped on or otherwise suitably attached to their respective sections. Like the plenum chamber 140, the first telescoping section 240 and the second telescoping section 340 jet an air curtain over the fire in the pit P.

Figure 10:
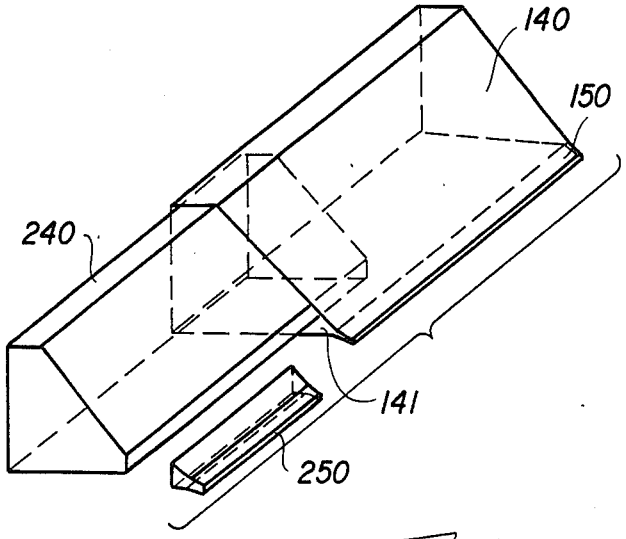
FIG. 10 is a perspective view of a third embodiment of the present invention with a section telescoping out of one side of the plenum chamber and with a nozzle being attached to the front of the section.

In FIG. 10, a third embodiment of the present invention is shown in which only the first telescoping section 240 slides out of one end 141 of the plenum chamber 140. There is no second telescoping section in this embodiment. As in the second embodiment, the third embodiment has a first nozzle-like snout 250 clipped or otherwise attached to the first telescoping section 240.

Figure 11:
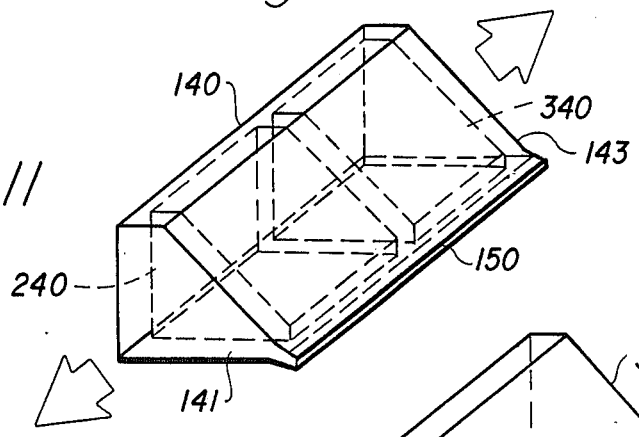
FIG. 11 is a perspective view of a fourth embodiment of the present invention with two sections each telescoping out of an opposite side of the plenum chamber without any nozzle attached to either section.

In FIG. 11, a fourth embodiment of the present invention is shown in which the first telescoping section 240 slides out of the the one end 141 of the plenum chamber 140 in one direction while the second telescoping section 340 slides out of an opposite end 143 of the plenum chamber 140 in an opposite direction. In this particular embodiment, both the first telescoping section 240 and the second telescoping section 340 are completely storable within the plenum chamber 140. Also, in this fourth embodiment, there are no nozzles or snouts attached at the jointures of the flat bases and the sloping front sides of the two telescoping sections 240 and 340 because such sections 240 and 340 are so short in length.

Figure 12:
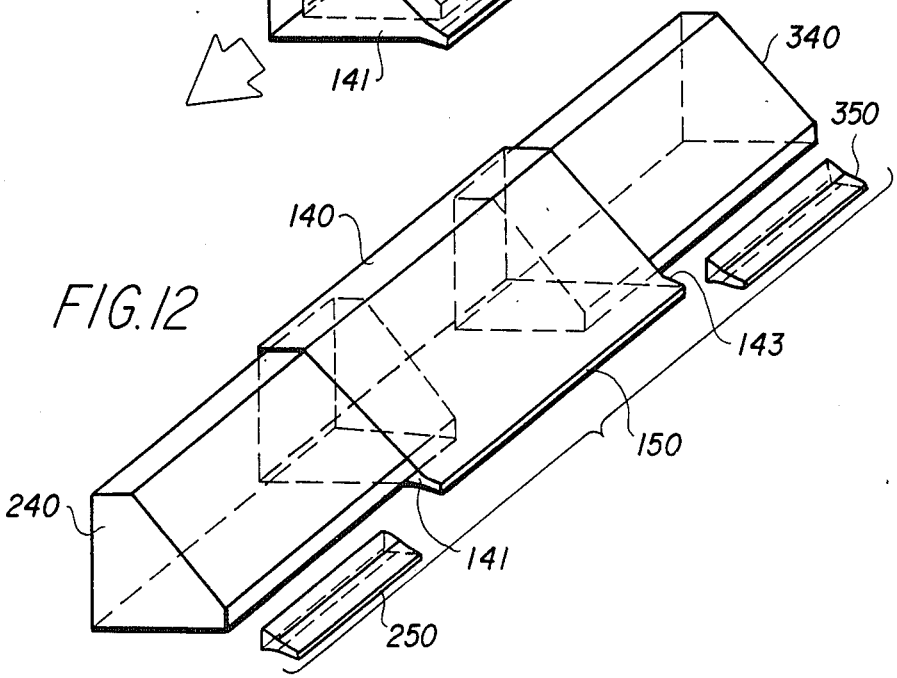
FIG. 12 is a perspective view of a fifth embodiment of the present invention with two sections each telescoping out of an opposite side of the plenum chamber and with a nozzle being attached to the front of each section.

In FIG. 12, a fifth embodiment of the present invention is shown to be similar to the fourth embodiment of FIG. 11. However, there are two major differences. First, both the first telescoping section 240 and the second telescoping sections 340 are so long that they are not completely storable within the plenum chamber 140 but rather both extend somewhat out of opposite sides of the plenum chamber 140, even if such sections 240 and 340 are stored to the maximum extent possible. The second difference between this fifth embodiment and the fourth embodiment shown in FIG. 11 is that a first nozzle-like snout 250 may be clipped or attached on the first telescoping section 240 and a second nozzle-like snout 350 may be likewise clipped or attached on the second telescoping section 340. Both the first snout 250 and the second snout 350 are necessary in the fifth embodiment of FIG. 12 because the sections 240 and 340 are so long in length.

The operation of the present invention will now be described with reference to FIGS. 2 through 6. Referring first to FIG. 4, the blower 100 is hauled by a truck T to a job site. There the blower 100 is unhitched from the back of the truck T and the hinge bars 180 are pivoted to bring the exit passage 128 for the duct 120 in alignment with the inlet passage 145 for the plenum chamber 140 so that the chamber 140 is perpendicular to the duct 120, as shown in FIG. 3. Because the blower 100 is portable, it may be easily rolled on it wheels 130, as shown in FIG. 3, to the edge E of an open incineration pit P, as shown in FIG. 6. Here the blower 100 is stabilized by the wide flat base 142 of the plenum chamber 140. Before the blower 100 is turned on, the protective fence sections 190 are removed from the side wall 125 of the duct 120 and are placed around the perimeter of the pit P, as shown in FIG. 5.

Returning to FIG. 6, operation is commenced by turning on the motor (not shown) stored in the housing 165. The motor drives the fan 170 inside the housing 175 so that air is forced through the duct 120 and into the plenum chamber 140. If there are additional telescoping sections 240 and/or 340 as shown in the second through fifth embodiments in FIGS. 9 through 12, then the air is also forced into these sections 240 and 340. Once inside the hollow chamber 140, the air is directly by the sloping front face 144 into the nozzle 150 which jets the air out, as shown in FIG. 2, like the curtain C that blankets the fire in the pit P. The air in the curtain C is heated by the combustion products which are contained in the pit P and all debris D in the pit P is reduced to ash. After the debris D is completely incinerated, the protective fence sections 190, shown in FIG. 5, are removed and restored on the side wall 125 of the duct 120, as shown in FIG. 6. Then, the blower 100, as seen in FIG. 2, is turned off and withdrawn from the edge E of the pit P. Thereafter, the debris D is covered over with earth and compacted down until the earth is level with the original ground G. Finally, as seen in FIG. 4, the blower 100 may be folded and towed to another pit P at the same location or to another job site.

The foregoing five preferred embodiments are considered illustrative only. Numerous other modifications will readily occur to those persons skilled in the pertinent technology after reading the foregoing disclosure. Consequently, the disclosed invention is not limited by the exact construction and operation shown and described above but rather is defined by the claims appended hereto.

What I claim as my invention is:

1. An air blower for use with an open fire incineration pit dug below ground level, comprising:

a. a motor;

b. a fan driven by the motor;

c. a plenum chamber means for receiving air from the fan, said chamber means having a cross-sectional shape of at least three sides including a flat base flush with the ground level and a front side sloping away from the pit; and d. a nozzle means, connected to the chamber means, for jetting an air curtain over an open fire in the pit;

wherein said chamber means has the cross-sectional shape of a trapezoid.

2. An air blower for use with an open fire incineration pit dug below ground level, comprising:

a. a motor;

b. a fan driven by the motor;

c. a plenum chamber means for receiving air from the fan, said chamber means having a cross-sectional shape of at least three sides including a flat base flush with the ground level and a front side sloping away from the pit; and d. a nozzle means, connected to the chamber means, for jetting an air curtain over an open fire in the pit;

wherein said nozzle means is connected to the chamber means at a juncture of the flat base and the sloping front side.

3. The air blower, according to claim 2, wherein:

said flat base seals the ground level against heat and combustion products generated by the fire in the pit.

4. The air blower, according to claim 2, further comprising:

enclosure means for housing the fan.

5. An air blower for use with an open fire incineration pit dug below ground level, comprising:

a. a motor;

b. a fan driven by the motor;

c. a plenum chamber means for receiving air from the fan, said chamber means having a cross-sectional shape of at least three sides including a flat base flush with the ground level and a front side sloping away from the pit;

d. a nozzle means, connected to the chamber means, for jetting an air curtain over an open fire in the pit; and e. lockable means, positioned behind an enclosure means for housing the fan, for protecting the motor from the open fire and from vandals.

6. The air blower, according to claim 5, further comprising:

a duct means, connected between the fan and the chamber means, for leading air from the fan to the chamber means, said duct means having a plurality of side walls.

7. An air blower for use with an open fire incineration pit dug below ground level, comprising:

a. a motor;

b. a fan driven by the motor;

c. a plenum chamber means for receiving air from the fan, said chamber means having a cross-sectional shape of at least three sides including a flat base flush with the ground level and a front side sloping away from the pit;

d. a nozzle means, connected to the chamber means, for jetting an air curtain over an open fire in the pit;

e. a duct means, connected between the fan and the chamber means, for leading air from the fan to the chamber means, said duct means having a plurality of side walls; and f. protective fence means, attachable to the chamber means, for surrounding the pit.

8. The air blower, according to claim 7, further comprising:

means, secured to at least one of the plurality of side walls of the duct means, for storing the protective fence means.

9. An air blower for use with an open fire incineration pit dug below ground level, comprising:

a. a motor;

b. a fan driven by the motor;

c. a plenum chamber means for receiving air from the fan, said chamber means having a cross-sectional shape of at least three sides including a flat base flush with the ground level and a front side sloping away from the pit;

d. a nozzle means, connected to the chamber means, for jetting an air curtain over an open fire in the pit;

e. a duct means, connected between the fan and the chamber means, for leading air from the fan to the chamber means, said duct means having a plurality of side walls; and f. hinge means, connected to the chamber means and the duct means, for pivoting the chamber means into fluid communication with the duct means.

10. An air blower for use with an open fire incineration pit dug below ground level, comprising:

a. a motor;

b. a fan driven by the motor;

c. a plenum chamber means for receiving air from the fan, said chamber means having a cross-sectional shape of at least three sides including a flat base flush with the ground level and a front side sloping away from the pit;

d. a nozzle means, connected to the chamber means, for jetting an air curtain over an open fire in the pit; and e. a first telescoping section means, slidable out of one end of the chamber means, for jetting a second air curtain over the open fire in the pit.

11. The air blower, according to claim 10, further comprising:

a second telescopig section means, slidable out of the first telescoping section means, for jetting a third air curtain over the open fire in the pit.

12. The air blower, according to claim 10, further comprising:

a second telescoping section means, slidable out of an opposite end of the chamber means, for jetting a third air curtain over the open fire in the pit.

13. The air blower, according to claim 11, further comprising:

a first nozzle-like snout attachable to the first telescoping section means; and a second nozzle-like snout attachable to the second telescoping section means.

14. The air blower, according to claim 12, further comprising:

a first nozzle-like snout attachable to the first telescoping section means; and a second nozzle-like snout attachable to the second telescoping section means

* * * * *

UNITED STATES PATENT AND TRADEMARK OFFICE

CERTIFICATE OF CORRECTION

PATENT NO. : 4,776,286

DATED : October 11, 1988

INVENTOR(S) : Leonard G. Blair

It is certified that error appears in the above-identified patent and that said Letters Patent is hereby corrected as shown below:

Col. 3, line 39, "$W_2$to" should be --$W_2$ to--.

Col. 3, line 56, "collegiate" should be --Collegiate--.

Col. 5, line 23, "for" should be --from--.

Signed and Sealed this

Twenty-first Day of February, 1989

*Attest:*

DONALD J. QUIGG

*Attesting Officer*

*Commissioner of Patents and Trademarks*